United States Patent [19]

Brown

[11] 4,141,667

[45] Feb. 27, 1979

[54] UNDERWATER PIPELINE LAYING METHOD AND APPARATUS

[75] Inventor: Robert J. Brown, The Hague, Netherlands

[73] Assignee: R. J. Brown and Associates AG, Zug, Switzerland

[21] Appl. No.: 841,586

[22] Filed: Oct. 11, 1977

[51] Int. Cl.[2] ..... F16L 1/00; E02F 5/06

[52] U.S. Cl. ..... 405/161; 37/193

[58] Field of Search ..... 61/72.4, 72.5, 72.6, 61/105; 37/193, 80 R, 80 A

[56] References Cited

U.S. PATENT DOCUMENTS

| | | | |
|---|---|---|---|
| 2,144,063 | 1/1939 | Irvin | 61/72.4 |
| 3,978,679 | 9/1976 | Lecomte | 61/72.4 |
| 3,995,439 | 12/1976 | Hahlbrock | 61/72.4 |

*Primary Examiner*—Jacob Shapiro

*Attorney, Agent, or Firm*—Cushman, Darby & Cushman

[57] ABSTRACT

A method and apparatus for laying pipeline in a bed substantially under water. Pipe is placed on the bed along the general line the pipeline will take. A trench is excavated in the bed generally parallel to the pipe by transporting spoil to the opposite side of the trench as the pipe and by excavating sufficient material adjacent the pipe so that the pipe will be supported by the bed after initial excavation but so that the bed ultimately will shear along a shear line under the weight of the pipe alone, so that the pipe will drop into the trench along with the material of the bed above the shear line. Material that has fallen into the trench after collapse of the pipe into the trench can be shifted out of the trench. The plow used for trenching includes a tandem set of wheels mounted to a forward portion of a frame, a center line of the plow extending between the wheels posterior thereof. A first share is mounted to the frame member posterior of the wheels and located asymmetrically with respect to the center line, and a mouldboard extends from the share to the opposite side of the center line as the share for depositing spoil on the opposite side of the center line as the share, and for counterbalancing the eccentric reaction on the share during trenching due to its asymmetrical mounting. A second share mounted posterior of the first share and also located asymmetrically with respect to the center line provides for removal of the material that falls into the trench with the pipe. Two sets of guide rollers are provided mounting to the frame and rotatable about vertical axes for engaging the pipe and guiding the movement of the plow as it is pulled during trenching.

21 Claims, 3 Drawing Figures

UNDERWATER PIPELINE LAYING METHOD AND APPARATUS

BACKGROUND AND SUMMARY OF THE INVENTION

This invention relates to methods and apparatus for forming trenches in beds located under water and laying pipeline in the trenches. Typical prior art structures and methods for doing this are shown in U.S. Pat. No. 2,144,063. According to the invention, it is desired to provide a method of laying pipeline in a bed substantially under water that may be utilized both in clay, sand, and mixtures of clay and sand, and can be done in a high speed manner with a minimum of accessory equipment. The pipeline must of course be layed along a predetermined desired line. According to the present invention is it also desired to provide apparatus that is relatively simple and uncomplicated, yet can effectively form a trench along a predetermined path and lay the pipe in the trench in a manner in which it will be advantageously disposed.

According to the present invention, a method of laying pipeline in a bed substantially under water is provided comprising the steps of disposing the pipe on the bed along the general line the pipeline will take, and excavating a trench in the bed generally parallel to the pipe by transporting spoil to the opposite side of the trench as the pipe and by excavating sufficient material adjacent the pipe so that the pipe will be supported by the bed after initial excavation but so that the bed ultimately will shear along a shear line under the weight of the pipe alone. In this way, the pipe drops into the trench, along with material of the bed above the shear line, in a simple and efficient manner after trenching. The excavating step is advantageously accomplished by forming a trench deeper than the diameter of the pipe that is trapezoidal in cross-section, with top, bottom, near wall, and far wall sides. The top and bottom sides are generally parallel and the near wall side — adjacent the pipe — is generally perpendicular to the top and bottom. The shear line is disposed at substantially the same angle with respect to the top side as the far side, although this angle can be greater. Material that has fallen into the trench after collapse of the pipe into the trench may be shifted out of the trench.

According to the present invention, a post trenching plow is provided comprising a frame member with a tandem set of wheels mounted to a forward portion of the frame member, a center line of the plow extending between the wheels posterior thereof. A first share is mounted to the frame member posterior of the wheels and located asymmetrically with respect to the center line. Means are provided for depositing the spoil on the opposite side of the center line as the share, and for counterbalancing the eccentric reaction on the share during trenching due to the asymmetrical mounting of the share, so that the plow may move in a straight line. The counterbalancing means and the depositing means may be provided by the same member — a mouldboard extending from the share to the opposite side of the center line as the share. Means for guiding the movement of the excavating means during trenching so that the trench is formed along predetermined lines also is preferably provided, including a plurality of guide rollers operatively mounted to the frame on the same side of the center line as the share, and rotatable about generally vertical axes, a pair of guide rollers being provided in each set with the surfaces of the rollers in each set being spaced apart a distance corresponding to the diameter of the pipe, or a cable or a like guiding structure, for engaging the guide member during trenching. A second (or more) share is also provided mounted posterior of the first share, also located asymmetrically with respect to the center line, for shifting material that collapsed into the trench with the pipe out of the trench.

It is the primary objects of the present invention to provide an advantageous method and apparatus for forming a trench in an under water bed and laying a pipeline in the trench. This and other objects of the invention will become clear from an inspection of the Detailed Description of the Invention, and from the appended claims.

DETAILED DESCRIPTION OF THE INVENTION

Figures 1, 2, 3:
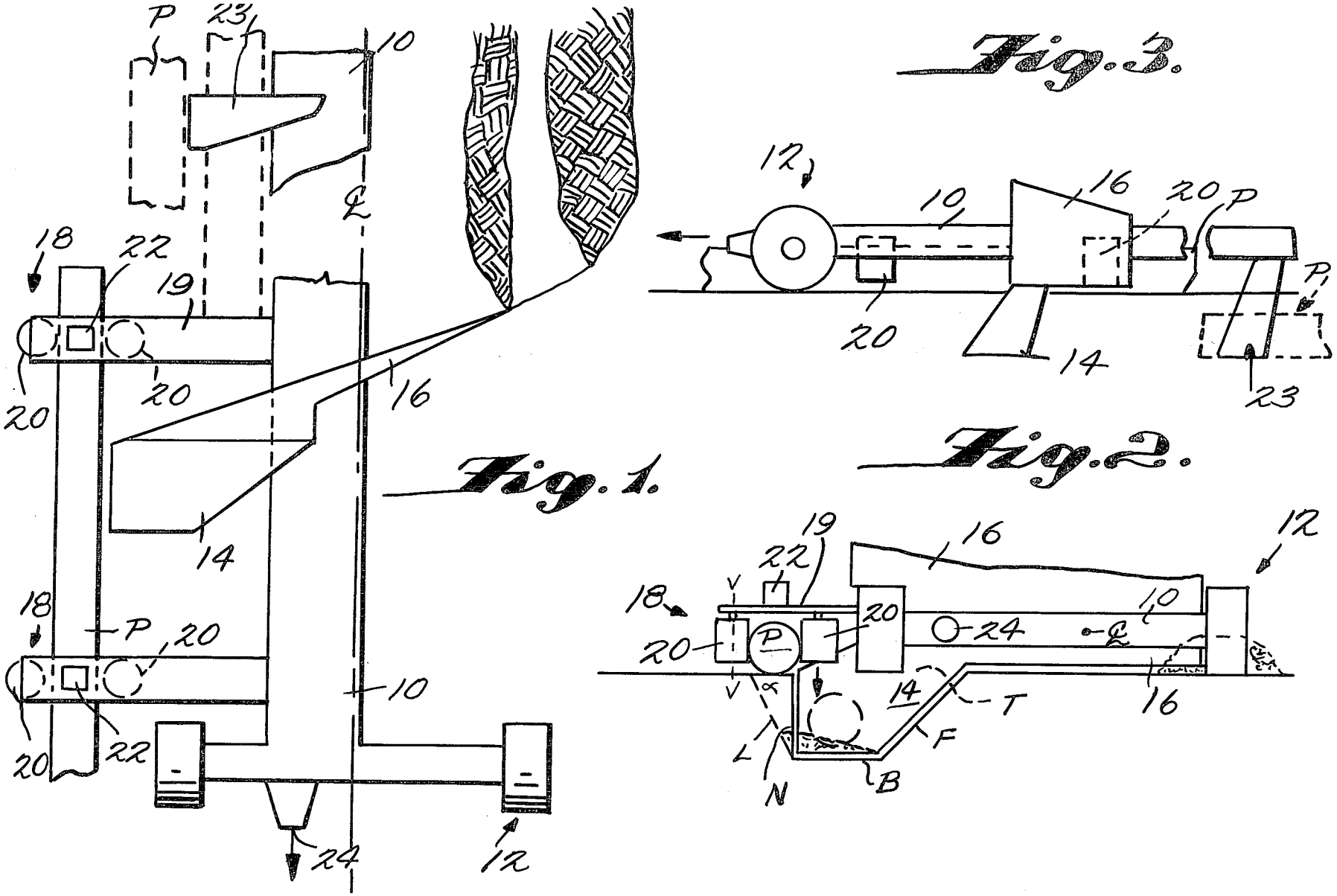
FIG. 1 is a top plan, schematic, view of exemplary apparatus according to the present invention.
FIG. 2 is a front view of the apparatus of FIG. 1, with some portions removed from clarity, and showing the details of the trench formed utilizing such apparatus.
FIG. 3 is a side view looking in direction S in FIG. 1 of the apparatus of FIG. 1.

A post trenching plow according to the invention is shown schematically in the drawings. The plow includes a frame member 10 that is elongated, with a tandem set of wheels 12 mounted to a forward portion of the frame 10, a center line CL of the plow extending between the wheels posterior thereof. A first share 14 is mounted to the frame member 10 posterior of the wheels 12, and located asymmetrically with respect to the center line CL (see FIGS. 1 and 2). The share 14 is asymmetric and wedge-shaped, so that it is capable of forming a trapezoidal trench in a bed disposed substantially under water. The trapezoidal cross-section of the trench formed by the share 14 can be readily seen in FIG. 2, the trench having parallel top T and bottom B sides, a near wall side N — adjacent pipe P to be laid in the trench — generally perpendicular to the top and bottom sides T, B, and a far wall side F making an angle $\alpha$ with respect to the top T. The share 14 — in cooperation with the mouldboard 16 — provides excavating means for excavating a trench along a predetermined line that a pipeline is to be laid in parallel to pipe P laid on the bed. Spoil is transported to the opposite side of the trench as the pipe P and sufficient material is excavated adjacent the pipe P by the share 14 (see FIG. 2) so that the bed will ultimately shear along a shear line L under the weight of the pipe so that the pipe will drop into the trench, along with material of the bed above the shear line. The fallen material, and the dropped pipe are shown in dotted line in FIG. 2.

The mouldboard 16 provides means for depositing spoil on the opposite side of the center line CL as the share 14, the mouldboard extending from the share 14 to the opposite side of the center line CL as the share, and the mouldboard depositing the spoil in a hill as shown schematically in FIGS. 1 and 2. The mouldboard preferably is of sufficient mass and has sufficient dimensions to counterbalance the eccentric reactions on the share 14 during trenching due to the asymmetrical mounting of the share 14, so that the plow may be moved in a straight line.

Means for guiding the movement of the excavating means during trenching so that the trench is formed along predetermined lines may include a plurality of guide rollers 18 operatively mounted to the frame, as by plates 19, on the same side of the center line CL as the share 14. The rollers are rotatable about vertical axes V—V, a pair guide rollers 20, 20 being provided in each set 18 of rollers, with the surfaces of the rollers in each set 18 being spaced apart a distance corresponding to the diameter of the pipe P, as shown most clearly in FIGS. 1 and 2. The rollers 20, 20 of each set may be spring biased together to provide for tight guiding engagement if desired. The counterbalancing provided by the mouldboard 16 reduces the sideways reactions on the guide rollers 20 to the minimum required for effective guiding, and the guide rollers 20 in turn provide some counterbalancing for the eccentric reaction on the share 14 during trenching. Any suitable conventional means — shown only in box form at 22 — may be provided for monitoring the side reactions on the pipe P and the pipe alignment, to either adjust the towing force, towing direction, bias on the guide rollers 20, etc. to insure that the pipe is laid in a straight line.

As shown in FIGS. 1 and 3, preferably two sets 18 of guide rollers 20 are provided, one set mounted posterior of the wheels 12 but anterior of the share 14, and the other set mounted posterior of the share 14 — generally even with the posterior termination of the mouldboard 16.

Since the material of the bed above the shear line L will collapse under the weight of the pipe P into the trench with the pipe P, sometimes it is desirable to provide means for shifting the collapsed material out of the trench. Such a function can be provided by a second share 23, or a plurality of other shares, mounted far enough posterior of the share 14 so that the collapse has taken place. The share 23 or like shares are so shaped and positioned to shift the collapsed material out of the trench without damaging the pipe P or unduly disturbing it.

A portion 24 of the frame 10 is provided anterior of the wheels 12 and on the same side of the center line CL as the share 14 for receiving a towing force supplying member, such as a tow rope connected to a barge, or connected to a winch on the shore. The center of balance of the plow considering the pull and drag forces will extend posterior of the plow through the frame portion 24.

According to the present invention, a method of laying pipeline in a bed substantially under water is provided that requires a minimum amount of equipment, and can effect laying at a reasonably fast laying speed, with accurate alignment. The steps according to the present invention include disposing the pipe P on the bed along the general line that the pipeline will take, and excavating a trench in the bed generally parallel to the pipe P by transporting spoil to the opposite side of the trench as the pipe P (see FIGS. 1 and 2) and by excavating sufficient material adjacent the pipe so that the pipe P will be supported by the bed after initial excavation, but so that the bed ultimaterly will shear along a shear line L (see FIG. 2) — under the weight of the pipe alone — so that the pipe will drop into the trench, along with material of the bed above the shear line L. The excavating step is accomplished by forming a trench that is trapezoidal in cross-section with the top and bottom sides T, B generally parallel and with the near wall side N—adjacent the pipe P — generally perpendicular to the top and bottom T, B. The shear line L is disposed at an angle $\beta$ — which will vary with the particular bed conditions and exact dimensions of the share and the towing speed, etc. — that is substantially the same as the angle $\alpha$, although it may be slightly greater as shown in FIG. 2.

After collapse of material into the trench with the pipe P, this material may be shifted out of the trench, as with the second and other shares 23. The trench excavated will preferably be deeper than the diameter of the pipe P (see FIG. 2), and the method according to the present invention may be practiced in beds of clay, sand, and mixtures of clay and sand. Sea shells, small rocks, and other underwater objects normally will not impair the practice of the method according to the invention.

The method of the invention is accomplished utilizing the plow shown in the drawings, the plow being guided in its path by the rollers 20 being disposed in contact with the pipe P. The method may comprise the further steps of monitoring the side reactions (with means 22) on and the alignment of the pipe to facilitate guiding the plow to produce a trench disposed properly along the line of the pipe, and may comprise the step of counterbalancing the reaction forces provided by the asymmetrically mounted one or more shares 14, 23 so that the plow remains straight during trenching. The towing force is applied at point 24 along a balancing line of the plow, taking pull and drag forces into account, such a line being located on the same side of the center line CL as the share 14.

It will thus be seen that an advantageous method and apparatus for forming a trench in an underwater bed and laying a pipeline have been provided. The invention has been shown only in schematic forms since any suitable convention structures may be utilized to form the component parts of the plow for practice of the invention. While the invention has been herein shown and described in what is presently considered to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and methods.

What is claimed is:

1. A method of laying pipeline in a bed substantially underwater, comprising the steps of disposing the pipe on the bed along the general line the pipeline will take, excavating a trench in said bed generally parallel to the pipe by transporting spoil to the opposite side of the trench as the pipe and by excavating sufficient material adjacent the pipe so that the pipe will be supported by the bed after initial excavation but so that the bed ultimately will shear along a shear line under the weight of the pipe so that the pipe will drop into the trench, along with material of the bed above the shear line, and shifting some material that has fallen into the trench, after collapse of the pipe into the trench, out of the trench.

2. A method as recited in claim 1 wherein said excavating step is accomplished by excavating a trench deeper than the diameter of the pipe.

3. A method of laying pipeline in a bed substantially underwater, comprising the steps of disposing the pipe on the bed along the general line the pipeline will take, and excavating a trench in said bed generally parallel to the pipe by transporting spoil to the opposite side of the trench as the pipe and by excavating sufficient material adjacent the pipe so that the pipe will be supported by the bed after initial excavation but so that the bed ultimately will shear along a shear line under the weight of the pipe so that the pipe will drop into the trench, along with material of the bed above the shear line, said excavating step being accomplished by forming a trench that is trapezoidal in cross-section with top, bottom, near wall, and far wall sides, with the top and bottom sides generally parallel and the near wall side-adjacent the pipe — generally perpendicular to the top and bottom; the shear line being disposed at substantially the same angle with respect to the top side as the far side.

4. A method as recited in claim 3 wherein the bed in which the trench is formed is selected from the group consisting of clay, sand, and mixtures of clay and sand.

5. A method of laying pipeline in a bed substantially underwater by utilizing a plow having a center line and one or more shares mounted asymmetrically with respect to the center line, comprising the steps of disposing the pipe on the bed along the general line the pipeline will take, excavating a trench in said bed generally parallel to the pipe by transporting spoil to the opposite side of the trench as the pipe and by excavating sufficient material adjacent the pipe so that the pipe will be supported by the bed after initial excavation but so that the bed ultimately will shear along a shear line under the weight of the pipe so that the pipe will drop into the trench, along with material of the bed above the shear line, and counterbalancing the reaction forces provided by the asymmetrically mounted shares so that the plow remains straight during trenching.

6. A method as recited in claim 5 comprising the further step of monitoring the side reactions and the pipe alignment to facilitate guiding of the plow to produce a trench disposed properly along the line of the pipe.

7. A post-trenching plow comprising a frame member, a tandem set of wheels, a center line of the plow extending between said wheels posterior thereof, said wheels mounted to a forward portion of said frame member, a first share mounted to said frame member posterior of said wheels and located asymmetrically with respect to the center line, means for counterbalancing the eccentric reaction on the share during trenching due to its asymmetrical mounting so that said plow may move in a straight line, and means for depositing spoils on the opposite side of the centerline as said share.

8. A plow as recited in claim 7 wherein said counterbalancing means and said depositing means comprise a mouldboard extending from said share to the opposite side of the centerline as said share.

9. A plow as recited in claim 7 further comprising a plurality of guide rollers operatively mounted to said frame on the same side of the centerline as said share, and rotatable about generally vertical axes, a pair of guide rollers being provided in each set with the surfaces of said rollers in each set being spaced apart a distance corresponding to the diameter of a guide member disposed parallel to a pipeline to be laid by said plow, said guide rollers adapted to engage said guide member during trenching.

10. A plow as recited in claim 9 further comprising a second share mounted posterior of said first share, said second share located asymmetrically with respect to the center line, and posterior of all of said guide rollers.

11. A plow as recited in claim 9 wherein said guide rollers are mounted posterior of said tandem wheels.

12. A plow as recited in claim 9 wherein said guide rollers comprise two sets, one set mounted anterior of said share but posterior of said wheels, and the other set mounted posterior of said share.

13. A plow as recited in claim 12 wherein the roller set mounted posterior of said share is mounted substantially even with the posterior termination of a mouldboard extending from said share to the opposite side of the centerline.

14. A plow as recited in claim 7 further comprising a portion of said frame for receiving a towingforce applying member, said portion located anterior of said wheels, and on the same side of the centerline as said share.

15. A post-trenching plow for laying a pipeline in a bed substantially underwater, comprising means for excavating a trench in said bed along a predetermined line the pipeline is to take parallel to pipe disposed on the bed, by transporting spoil to the opposite side of the trench as the pipe and by excavating sufficient material adjacent the pipe so that the pipe will be supported by the bed after initial excavation but so that the bed will ulitmately shear along a shear line under the weight of the pipe so that the pipe will drop into the trench, along with material of the bed above the shear line, said excavating means comprising a frame member, a tandem set of wheels mounted to a forward portion of said frame member with a center line of the plow extending between said wheels posterior thereof, a first share mounted to said frame member posterior of said wheels and located asymmetrically with respect to the center line, and a mouldboard extending from said share to the opposite side of the center line for depositing spoil on the oppposite side of the center line as said share; and means for guiding the movement of the excavating means during trenching so that the trench is formed along predetermined lines, including means engaging the pipe.

16. A plow as recited in claim 15 wherein said guiding means comprise a plurality of rollers rotatable about vertical axes and disposed in sets with two rollers of each set engaging opposite sides of the pipe.

17. A plow as recited in claim 16 wherein said mouldboard has sufficient mass and is of sufficient dimensions so that it effectively counterbalances the eccentric reaction on the share during trenching due to its asymmetrical mounting, and reduces the sideways reaction on said rollers.

18. A plow as recited in claim 16 wherein at least two roller sets are provided, a first set mounted anterior of said share but posterior of said wheels, and a second set mounted posterior of said share.

19. A plow as recited in claim 15 wherein said mouldboard has sufficient mass and is of sufficient dimensions so that it effectively counterbalances the eccentric reaction on the share during trenching due to its asymmetrical mounting.

20. A plow as recited in claim 15 further comprising means for shifting bed material that has sunk into the trench with the pipe out of the trench, said means comprising a second share disposed posteriorly of said first share.

21. A post-trenching plow for laying a pipeline in a bed substantially underwater, comprising means for excavating a trench in said bed along a predetermined line the pipeline is to take parallel to pipe disposed on the bed, by transporting spoil to the opposite side of the trench as the pipe and by excavating sufficient material adjacent the pipe so that the pipe will be supported by the bed after initial excavation but so that the bed will ultimately shear along a shear line under the weight of the pipe so that the pipe will drop into the trench, along with material of the bed above the shear line, said excavating means comprising means for forming a trench that is trapezoidal in cross-section with top, bottom, near wall, and far wall sides, with the top and bottom sides generally parallel and the near wall side — adjacent the pipe — generally perpendicular to the top and bottom sides; the shear line being disposed at substantially the same angle with respect to the top side as the far side; and means for guiding the movement of the excavating means during trenching so that the trench is formed along predetermined lines, including means engaging the pipe.

* * * * *